United States Patent [19]

Willing

[11] 4,390,934

[45] Jun. 28, 1983

[54] SIGNAL LAMP

[75] Inventor: Achim Willing, Doschendorf, Fed. Rep. of Germany

[73] Assignee: Auer-Sog Glaswerke GmbH, Bad Gandersheim, Fed. Rep. of Germany

[21] Appl. No.: 267,079

[22] Filed: May 26, 1981

[30] Foreign Application Priority Data

May 27, 1980 [DE] Fed. Rep. of Germany ..... 3020097

[51] Int. Cl.[3] ..... F21V 7/00

[52] U.S. Cl. ..... 362/291; 362/309; 362/329; 362/342; 362/343

[58] Field of Search ..... 362/61, 80, 83, 290, 362/291, 309, 328, 329, 342, 343; 340/84

[56] References Cited

U.S. PATENT DOCUMENTS

| | | | |
|---|---|---|---|
| 1,806,051 | 5/1931 | Fisher | 362/291 |
| 2,142,964 | 1/1939 | Godley | 362/309 |
| 3,377,479 | 4/1968 | Schreiber | 362/309 |
| 4,152,756 | 5/1979 | Wrege | 362/291 |

FOREIGN PATENT DOCUMENTS

| | | | |
|---|---|---|---|
| 610148 | 1/1926 | France | 362/291 |

*Primary Examiner*—Donald P. Walsh

*Attorney, Agent, or Firm*—Quaintance & Murphy

[57] ABSTRACT

A signal lamp having a light source, a reflector, and a dispersion sheet wherein the dispersion sheet is divided into a plurality of dispersion elements constructed so as to minimize the adverse effect of incident stray light and minimize or eliminate the occurrence of phantom light effect.

10 Claims, 4 Drawing Figures

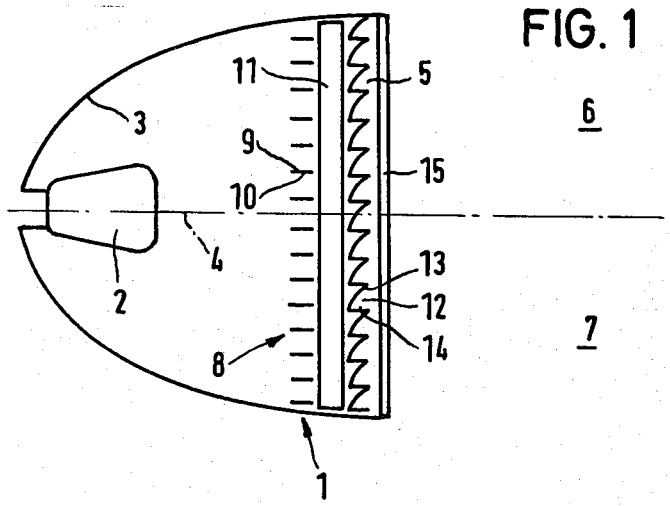
FIG. 1
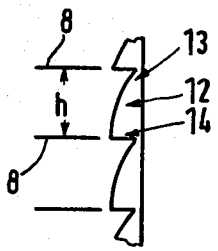
FIG. 2
FIG. 4
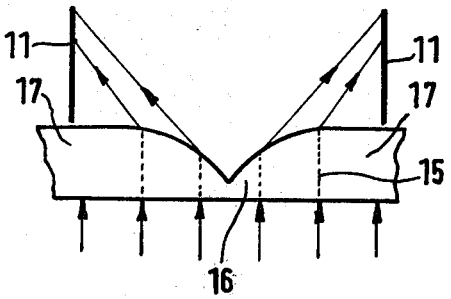
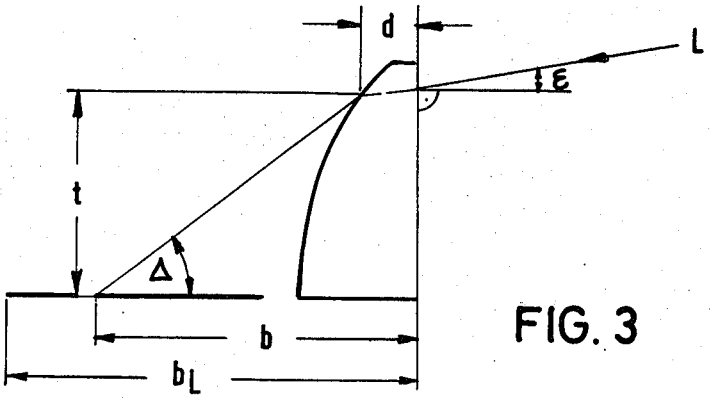
FIG. 3

SIGNAL LAMP

This invention relates to a signal lamp with a light source, light bundling optics arranged with respect to the light source, a dispersion sheet having dispersion elements for the emitted light and strips arranged at intervals from each other between the light source and the dispersion sheet for upper side absorption of incident outer stray light.

A similar signal lamp is already known (DE-OS 26 34 522). This known signal lamp is envisioned as a headlamp for an automobile. Signal lamps, especially also in the form of traffic lamps and the like must deliver information that cannot be confused. This is especially true with respect to the color as well as the operational condition so that it is clearly determinable whether a color is lit or not. Therefore, the operational conditions of signal light strength and light density are limited by the minimum lighting that will attract attention when viewed from below; by the danger of blending with a dark background when viewed from above; and by the requirement of limited energy consumption in bright surroundings.

Therefore, signal lamps having a desirably great luminosity cannot be employed. This results in the danger that external stray light, especially sunlight in the case of traffic lamps, is so brightly lit from reflection that such a lamp can be confused with a lamp that is not even turned on. Sunlight reflected by a traffic lamp is also known as "phantom light." Phantom light can result from reflection from the forward side of the lens, from the boundary surfaces of the dispersion elements of the dispersion sheet and from the mirror-like surfaces of the reflectors and from the lightbulbs.

Horizontal strips in known signal lamps serve to inhibit the production of phantom light in a manner similar to that of a bonnet positioned roof-like over a signal lamp to shield it from sunlight. It is apparent that only in limited circumstances does such a bonnet limit the receiption of sunlight into the traffic lamp and its conversion to phantom light. Furthermore, the parallel strips no longer have the desired effect when the sun is low in the sky. It has been attempted to catch and adsorb flat incident sunlight with the upper side of the strips by reducing the distance between adjacent strips and by increasing the depth of the strips in the horizontal direction. However, these actions simultaneously produce an appreciable reduction in the operational condition of the signal light with a consequent undesirable increase in energy consumption. Finally, horizontally incident stray light cannot be effectively eliminated.

Accordingly, it is an object of the present invention to provide a signal lamp that: does not cause an appreciable cost increase; has regard to the manufacturer and the operation of the lamp and the creation of phantom light by means of incident stray light which is further reduced especially also with respect to stray light that invades the lamp from the area intersecting the disturbing light space and the observer's space.

The objects of the present invention are realized by providing a signal lamp in which the interval between strips corresponds substantially to the height of the dispersion elements; that the strips are arranged in the vertical direction substantially coincidental with the intersection between adjacent connected dispersion elements; and that the dispersion elements are so arranged such that incident light reaching them from the horizontal or from above in their upper areas is bent more strongly downward than light reaching them in their lower areas.

By means of this construction and specific arrangement of the dispersion elements with respect to the strips, incident light on the upper side of the strips is bent and through absorption is rendered unobjectionable. In this manner, it is possible to arrange the distribution elements such that theoretically all stray light as well as disturbing light beams reaching the upper side of the strips are bent. If one divides the space in front of the traffic lamp into an upper half above the optical axis of the lamp or disturbing light hemisphere and into a substantially lower half along the optical axis or an observer's hemisphere, then it can be said that pure disturbing rays will not be absorbed that come exactly from the border between the disturbing hemisphere and the observer's hemisphere or which come after turning the signal lamp on or which come from the existing transition zone between the disturbing light space and the observer's space if a portion of it strikes the distribution element which is simultaneously sending the signal light in that direction. However, also in this case, the phantom light will be severely attenuated in relationship to the previously existing comparisons.

Useful forms and further constructions will be apparent by reference to the dependent claims. The arrangement of supplemental vertical strips and the lateral bending of incident stray light of these strips leads to a further reduction in the danger of creation of phantom light.

The invention and its operation is further explained by reference to the schematic drawings wherein:

FIG. 1 is a vertical sectional view through the optical axis of the signal light; and FIG. 2 is an enlarged sectional view taken from FIG. 1 with dispersion elements and their associated horizontal strips omitting other lamp elements; and FIG. 3 is a further enlarged vertical sectional view of the bending of an incident stray light beam by means of a dispersion element on the upper side of a horizontal strip; and FIG. 4 is a horizontal sectional view taken with respect to FIG. 1 of a dispersion element arranged with respect to two adjacent vertical strips omitting certain lamp parts in order to more clearly show the lateral bending of stray light that is incident on the vertical strips.

According to FIG. 1, the signal lamp 1 comprises a light source 2, light-bundling optics in the form of a reflector 3 having an optical axis 4 and a dispersion sheet 5. The optical axis 4 taken with the associated horizontal plane divides the upper disturbing light hemisphere 6 from the lower observer's hemisphere 7.

Horizontal strips 8 are arranged at even intervals from one another between the dispersion plate 5 and the light source 2. These horizontal strips 8 have a light-absorbing upper side 9 and a light-reflecting under side 10. Vertical strips 11 arranged at even intervals are located between the dispersion plate 5 and the light source 2. The horizontal strips 8 and the vertical strips 11 are arranged in the direction of the optical axis 4 but are displaced from one another. They can, however, usefully be arranged by constructing them in the form of a grid. Furthermore, the strips 8 and/or the strips 11 can be rotable about the optical axis 4 as desired in order to meet the special uses of the device considering the nature of the stray light and to achieve optimum suppression of phantom light.

The dispersion sheet 5 has on its inner side dispersion elements 12 which extend in the horizontal direction each having the distance between adjacent horizontal strips 8 corresponding to the height as well as the intermediate space between two adjacent horizontal strips 8. In this manner, the dispersion elements 12 are arranged such that in their upper zone 13 a substantially horizontal incident stray light beam is bent more strongly down than in its lower zone 14. For this reason, the disperson elements 12 exhibit a rather sawtooth profile. The construction and arrangement of the dispersion elements 12 compared to the strips 8 and the interval "h" between them is arranged as shown in FIG. 2.

According to FIG. 3, the interval "b" characterizing the departure point of an incident light ray "L" is dependent upon the bending Δ. The following relationship exists:

$$\tan \Delta = (b-d)/t, \text{ therefore}$$

$$b = t \cdot \tan \Delta + d$$

In this manner, the depth $b_L$ of an ideal strip 8 can be determined by incident height "t" which is dependent on the impact point which is furthest from the dispersion sheet 5. A smaller value $b_L$ indicates the creation of phantom light.

In practical forms of the present invention, one will always strive to have a strip be as close as possible to the depth of an ideal strip ($b_{max}$) in accordance with the following relationship:

$$b_L = b_{max}$$

Furthermore, the value $b_{max}$ is dependent upon the border of the defined disturbing light hemisphere 6 and from the flatest angle of incidence E. Basically, within the optical conditions $b_L = b_{max}$, all forms of dispersion elements 12 which are effective are possible.

Rendering the under side of the strips light reflective is therefore desirable when the natural dispersion of the emitted signal light as well as the illuminated optics is so great that many beams fall on the under sides 10 of the strips. In this case, rendering the under side 10 of the strips light reflective leads to an increase in the light effectiveness. At the same time, rendering the under side light reflective and eventually also the structure of the device of the present invention leads to an increase in the downward dispersion and lateral dispersion already from the passage through the dispersion sheet 5 so that the prism angle of the dispersion element 12 can be maintained correspondingly smaller. This in turn causes a reduction in the already reflected stray light from the dispersion element 12 of the dispersion sheet 5 which adversely affects the dispersion sheet phantom. Because of this dispersion sheet phantom effect, the light which is incident on the dispersion sheet 5 from outside is not only broken but is also reflected.

According to Newton, the degree of reflection is dependent upon the angle and takes into consideration the angle of incidence. The following relationship exists:

$$\bar{\rho} = \frac{1}{2}\left(\frac{\sin^2(E_1 - E_2)}{\sin^2(E_1 + E_2)} + \frac{\tan^2(E_1 - E_2)}{\tan^2(E_1 + E_2)}\right)$$

wherein $\bar{\rho}$ is the degree of reflection; and $E_1$ is the angle to the normal to the plane in medium 1 and $E_2$ is the angle to the normal to the plane in medium 2.

These considerations can be especially important in the case of railroad signals having clear, uncolored lenses wherein the disturbing light is not reduced which would be the case if the lens was colored.

In certain cases, an extreme phantom light suppression is achieved even in the case of the smallest possible angle of incidence of the disturbing light. It is also conceivable that the disturbing light space 6 and the observer's space 7 can easily overlap.

Especially in these cases, it is desirable to supplement the horizontal strips 8 with vertical strips 11. The function of the vertical strips 11 in phantom light suppression can be seen by reference to FIG. 4. Therein, each intermediate space between two adjacent vertical strips 11 has a dispersion element 15 arranged within it in the vertical direction. That is formed as shown so that in its central zone 16 incident light beams are more strongly deflected than in its lateral zone 17 on the neighboring flat side of the next adjacent vertical strip 8. In this manner, by means of the vertically running and laterally connected dispersion elements 15, incident stray light reflects off the vertical strip 11 is bent and in this manner absorbed and is rendered unobjectionable.

The greatest phantom light suppression by means of this lateral bending of the incident stray light corresponds in general to the previously described phantom light suppression by means of vertical bending of the incident stray light beams. In the case of vertical bending, the stray light beams on the upper side of the strips in this manner are to be generally bent downwards, for every vertical dispersion element 15, two intermediate adjacent vertical strips 11 stand between with two absorbing strip surfaces first at FIG. 4 shows a symmetrical arrangement by which in the left zone the bending occurs laterally to the left and in the right zone laterally to the right. Because of the enhanced bending in the central zone 16 of the dispersion elements, there is present the described form of the dispersion element 15 with a vertical cut substantially in the middle between the adjacnet strips 11. Departures can also be made from the symmetrical arrangement without eliminating completely the advantage of the great stray light absorption.

The considerations for optimum suppression of phantom light relate relative to the vertical strips next only for a given direction of the disturbing light beams which are shown in FIG. 4 by means of arrows. Therefrom, the parting directions cause as always if the disturbing light space and the observer's space overlap and produce a somewhat undesirable result and less optimum results.

It can also be desirable to provide the vertical strips with a light-reflective covering on one or both sides and to arrange them in a manner not parallel to the entrance direction of the rays. Furthermore, the vertical strips can be specially constructed and arranged at an angle to one another. This is desirable in the case of signals having a large lateral dispersion in order to achieve lateral dispersion on the one hand but also to minimize phantom light caused by the large prism angle on the other hand. It is also conceivable to arrange light-reflective vertfical strips as well as light-absorbing vertical strips.

In each case of given light division, the corresponding solution for difference entrance directions must be checked in order to achieve optimum solution overall.

The light-carrying optics can comprise a reflector such as the reflector 3 in FIG. 1. This is generally the situation in the case of signal lamps for street traffic. The optics can, however, comprise a lens or a lens system such as is common in the case of railroad signal lamps. Furthermore, combinations of reflectors and lenses are possible.

The dispersion sheet 5 can be flat or curved. The horizontal dispersion element 12 and the vertical dispersion element 15 can be periodically repeated over the entire dispersion sheet 5. The individual dispersion elements can also be variously constructed or can be composed of groups of similar dispersion elements which cover the dispersion sheet 5. A similar construction is possible in which the groups repeat themselves and in which the individual dispersion elements of a typical type are arranged differently.

In all these cases, it is advantageous to arrange these strips in the special arrangement of the dispersion elements. Under limited requirements for disturbing light suppression and also with special forms of light-bundling optics, the described optimization principles of this type can be disregarded in that individual dispersion elements or groups of dispersion elements can remain without supplemental strips.

The horizontal dispersion elements 12 and the vertical dispersion elements 15 can be located on opposite sides of the dispersion sheet 5 or both on the same side of the dispersion sheet 5 as shown in FIG. 1. Furthermore, the device can have two dispersion sheets arranged one behind another, one carrying the horizontal dispersion element 12 and one carrying the vertical dispersion element 15.

I claim:

1. A signal lamp having a light source, light bundling optics arranged to receive light from the light source, a dispersion sheet carrying dispersion elements adapted to receive the light, strips horizontally arranged between the light source and the dispersion shield evenly spaced from one another having their upper sides light absorptive with respect to incident outer stray light characterized in that the interval "h" between adjacent strips 8 corresponds substantially to the height of a single given dispersion element 12; and the horizontal strips 8 are arranged coincidentally with the transition from one dispersion element 12 to the next adjacent dispersion element 12; and the dispersion elements 12 are constructed such that light "L" which contacts them from above or in the horizontal direction is bent more severely downward when the light contacts the upper zone of the dispersion element than when it contacts the lower zone of the dispersion element.

2. A signal lamp of claim 1 characterized in that the under side 10 of the horizontal strips is rendered light reflective.

3. A signal lamp of claim 1 or 2 characterized in that it comprises vertical strips 11 in addition to horizontal strips 8 wherein the vertical strips 11 are arranged across the dispersion sheet 5 at an even interval that the individual dispersion elements 15 are directly attached to each other;

that the vertical strips 11 are at the transition between laterally adjacent transition elements 15; and that the dispersion elements 15 are arranged such that light incident in the side direction at various points is divided and is bent severely laterally.

4. A signal lamp of claim 3 characterized in that the central zone of the dispersion element 15 which central zone lies between adjacent vertical strips 11 bends light laterally to a degree greater than light is bent which contacts the side zones of the dispersion element 15.

5. A signal lamp of claim 3 or 4 characterized in that vertical strips 11 have a light-absorptive upper surface.

6. A signal lamp of claim 3 or 4 characterized in that one or both sides of the strips 11 have a light-reflective surface.

7. A signal lamp of any of claims 3–6 characterized in that both lateral surfaces of the vertical strips 11 are arranged at an angle to one another when viewed in the vertical direction.

8. A signal lamp of any one of claims 3–7 characterized in that the horizontal strips 8 on the one hand and the vertical strips 11 on the other hand are arranged with axial intervals in the direction of the axis 4 of the light-bundling optics 3.

9. A signal lamp of any of claims 1–8 characterized in that the horizontal strips 8 and/or the vertical strips 11 are adjustable in a sloping direction by means of deviation about the axis 4.

10. A signal lamp comprising:

A. a light source; and

B. a reflector adapted to receive light from the light source and reflect the light substantially in one direction; and C. a dispersion sheet positioned away from the light source in the direction in which the reflector reflects the light, said dispersion sheet having (1) a substantially planar outer surface; and (2) an inner surface divided horizontally into a plurality of dispersion elements wherein each dispersion element extends substantially completely in the horizontal direction across the inside surface of the dispersion plate wherein each dispersion element is upwardly and outwardly curved from the bottom to the top wherein the radius of curvature in the upper zone of the dispersion element is greater than the radius of curvature in the lower zone of the dispersion element; and (3) a plurality of horizontal strips spaced between the dispersion plate and the light source, said dispersion strips each being placed on a plane defined by the intersection of adjacent dispersion elements; said strips extending laterally a distance sufficient to adsorb substantially all stray light passing through the dispersion plate in a direction opposite to that of light from the light source.

* * * * *